US006036020A

United States Patent [19]

Distler

[11] Patent Number: 6,036,020

[45] Date of Patent: Mar. 14, 2000

[54] DINNER TRAY

[76] Inventor: Las Distler, 4524 Poe Ave., Woodland Hills, Calif. 91364

[21] Appl. No.: 09/264,175

[22] Filed: Mar. 5, 1999

[51] Int. Cl.[7] ..... B65D 1/34

[52] U.S. Cl. ..... 206/564; 206/217; 220/556

[58] Field of Search ..... 206/217, 541, 206/549, 564; 220/17.1, 556, 575; 229/407, 904; D7/553.1, 553.2

[56] References Cited

U.S. PATENT DOCUMENTS

| | | | |
|---|---|---|---|
| D. 305,192 | 12/1989 | Van Erkel | D7/553.1 |
| 3,674,168 | 7/1972 | Padovani | 229/407 |
| 3,915,371 | 10/1975 | Crabtree | 229/407 |
| 4,208,006 | 6/1980 | Bixler et al. | 206/554 |
| 4,218,008 | 8/1980 | Veilleux | 229/904 |
| 4,838,444 | 6/1989 | Bitel | 220/556 |
| 5,368,183 | 11/1994 | Singer | 220/556 |
| 5,421,459 | 6/1995 | Mazzotti | 206/564 |
| 5,697,512 | 12/1997 | Brickley | 206/564 |
| 5,915,561 | 6/1999 | Lorenzana et al. | 206/556 |

*Primary Examiner*—David T. Fidei
*Attorney, Agent, or Firm*—James G. O'Neill

[57] ABSTRACT

A dinner tray for safely carrying food, a number of cups and condiments includes a body having substantially flat top surface, a pair of sides, a pair of ends, and a surrounding annular lip. At least two octagonal shaped cup holding compartments having stepped down inner surfaces with slit openings and flat bottom surfaces therein to hold various size cups. A flat food holding surface is recessed into the top surface, and an elongated condiment reservoir is formed in the flat food holding surface extending between the pair of sides. The dinner tray may take several configurations, including one with two cup holding compartments at one end and the condiment reservoir at another end with the flat food holding surface therebetween. Or, the dinner tray may include one or two cup holding compartments at each end and the food holding surface and condiment reservoir formed between the end cup holding compartments.

19 Claims, 3 Drawing Sheets

DINNER TRAY

BACKGROUND OF THE INVENTION

1. Field of the Invention

This invention relates generally to trays, and, more particularly, to an improved dinner tray for supporting a plurality of beverage cups, as well as food and condiments therein 2. Description of Related Art As is well known, in many types of bars, convenience stores, movies, theaters and restaurants, a consumer will order drinks and/or food to go, or for carrying to a table, vehicle, or the like, for consumption. To better able the consumer to carry the drinks and/or food orders, many establishments provide a basket, box or flat tray. Such baskets, boxes and flat trays may be flimsy or do not hold beverages and condiments in place, and cannot always be successfully used to safely transport consumable items to a table, vehicle, or the like. For example, the food or beverage in a basket or on a tray might slide or fall off and strike a person or other item, requiring time and expense in cleaning and/or mopping up the ensuing mess. Furthermore, if a beverage spilled is hot, the consumer or a bystander could suffer injury. In any event, the food and beverages would be wasted, and some or all of the meal and condiments would be lost.

Therefore, there exists a need in the art for an improved dinner tray for holding a number of beverage cups in place, and which also provides a flat surface for supporting food and a slotted area to hold condiments securely therein.

SUMMARY OF THE INVENTION

Accordingly, it is a general object of the present invention to provide an improved dinner tray. It is a particular object of the present invention to provide an improved dinner tray having a plurality of beverage holding areas therein. It is another particular object of the present invention to provide an improved dinner tray, having a plurality of beverage holding areas, a flat food carrying area and a holding area for condiments for use with the food and/or beverage carried in the tray. It is yet another particular object of the present invention to provide an improved dinner tray having a plurality of cup holding areas at either or both ends thereof capable of accommodating different sized cups, with a flat area between and spaced from the cup holding areas, and a slotted condiment holding area spaced from the beverage holding areas. And, it is a still further particular object of the present invention to provide an improved dinner tray having beverage cup holding areas, which contain specifically shaped openings having slitted portions therein to accommodate and hold various size cups.

These and other aspects of the present invention are achieved by providing a dinner tray having a plurality of specifically shaped beverage holding compartments adjacent a flat food supporting area surmounted by an annular lip and a condiment holding area. The bottoms of the plurality of beverage holding compartments and the condiment opening are formed so as to support the tray in a horizontal position on a flat surface.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

Figure 1:
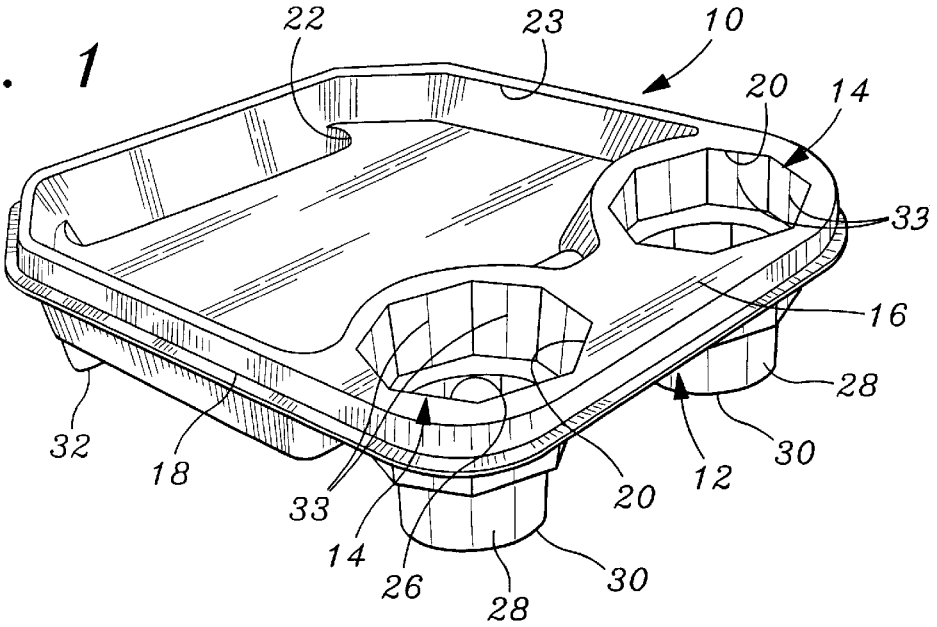
FIG. 1 is a perspective view showing a first embodiment of the improved dinner tray of the present invention.
Figure 2:
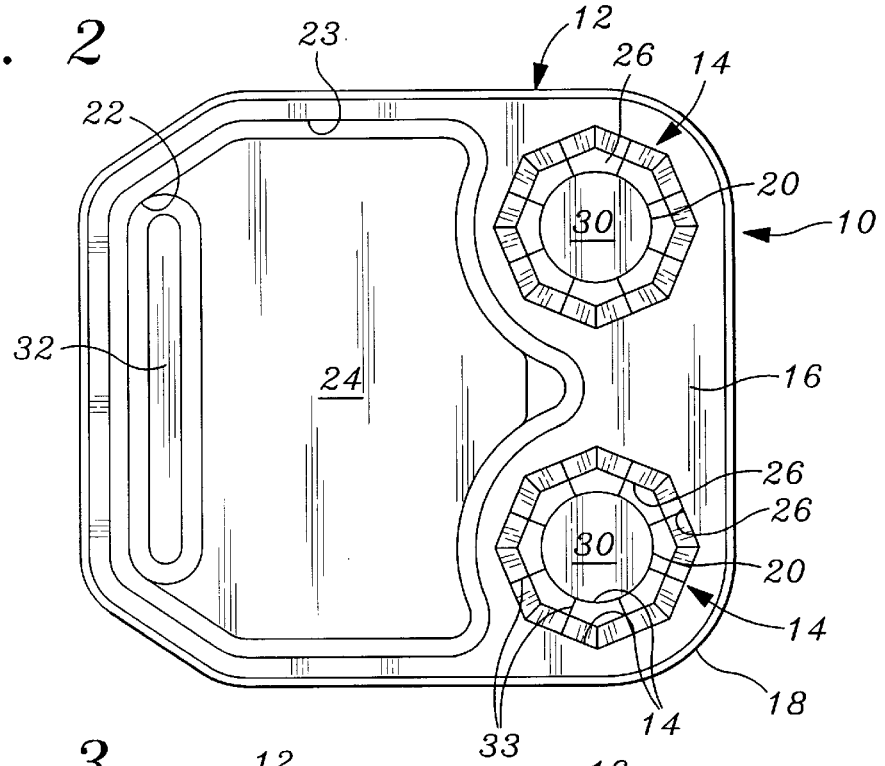
FIG. 2 is a top plan view of the dinner tray of FIG. 1.
Figure 3:
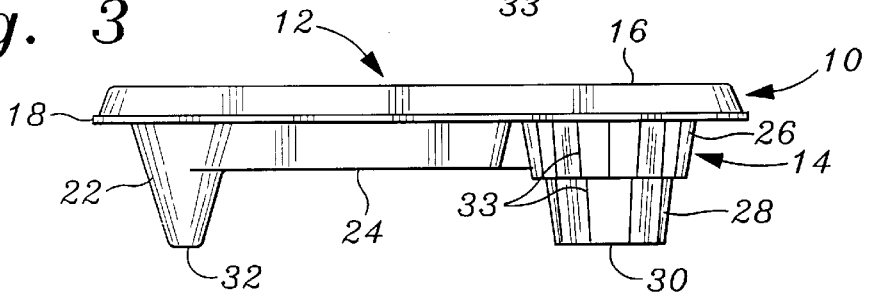
FIG. 3 is a side elevational view of the dinner tray of FIG. 1.

The following description is provided to enable any person skilled in the art to make and use the invention and sets forth the best modes contemplated by the inventor of carrying out her invention. Various modifications, however, will remain readily apparent to those skilled in the art, since the generic principles of the present invention have been defined herein specifically to provide for a novel and improved dinner tray 10 having a substantially rectangular body 12 with rounded and/or slanted corner portions and a plurality of cup holding compartments 14, formed in a flat top portion 16. An annular lip 18 is connected to the outside edge of the flat top portion 16 and extends entirely around the body 12. The cup holding compartments 14 are preferably formed with hexagonal top openings 20 at a first end of the body 12. In the second end of the body 12, opposite to the first end there is formed a condiment holding area 22, such as an elongated reservoir or trough. Food may be held on the tray in a flat, horizontal surface 24 recessed in the flat top surface, between the first and second ends. An elevated rim or wall 23 surrounds the recessed flat surface 24. Each of the plurality of cup holding compartments 14 is preferably formed with two stepped portions 26, 28, of different sizes, but of approximately equal height, thereby dividing the depth of the cup compartments into two equal recesses, or pockets. Each of the stepped portions 26, 28 are capable of holding different size beverage containers or cups, ranging from approximately 8 ounces through approximately 32 ounces. Additionally, each of the cup holding compartments 14 ends in a substantially flat, circular bottom portion 30 to support a small cup thereon, and so as to be capable of supporting the tray 10 in a horizontal position on a flat surface. Additionally, the condiment holding area 22 also preferably ends in a flat bottom surface 32, which flat bottom surface also aids in supporting the dinner tray 10 in the horizontal position on a flat surface.

To further enable different size cups to be inserted and firmly held within the cup holding compartments 14 each of the octagonal sides in both the upper portion 26 and lower portion 28 is provided with slits or other opening 33 formed therein. Each of the slits 33 enable the octagonal slotted portions in the upper and lower stepped areas 26,28 to be spread apart by the insertion of a cup therein, to thereby grasp and hold, such different size cups in position.

The dinner tray of the present invention is adapted to be used by a consumer when they purchase one or more drinks, food and/or condiments, which are placed in the appropriate areas in the tray, and then carried by the consumer to a table or other flat surface, or a vehicle. The dinner tray may then be supported on the flat surface, in the hand or hands of a user, or on a user's lap, so that the one or more users may eat the food items and/or drink beverages from the cups held within the openings 14.

Figure 4:
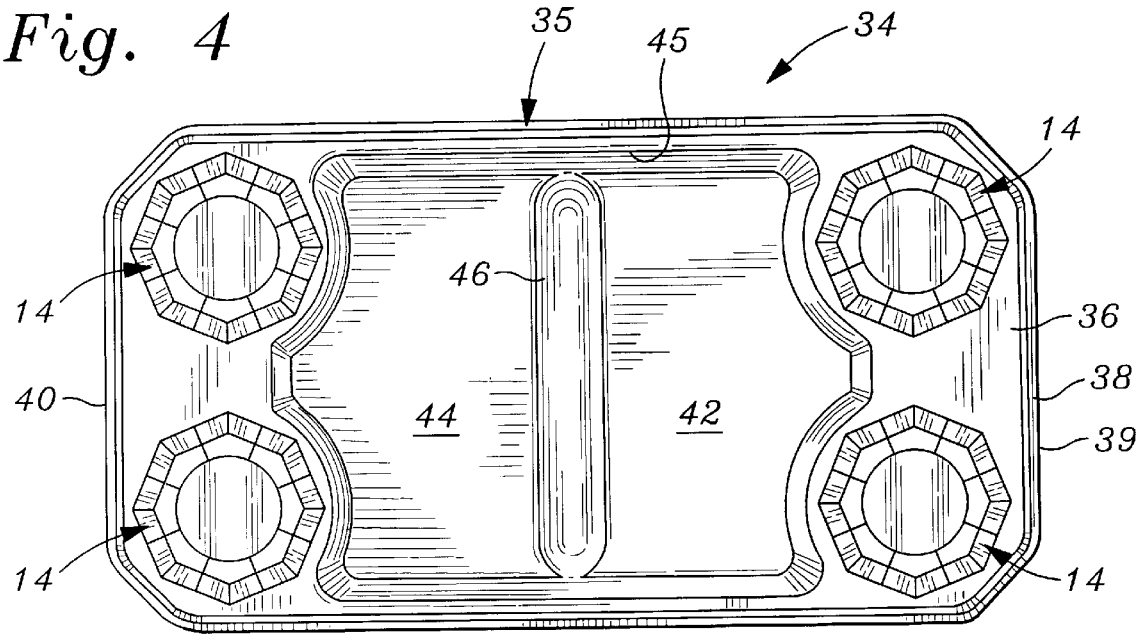
FIG. 4 is a top plan view of a second embodiment of the improved dinner tray of the present invention.
Figure 5:
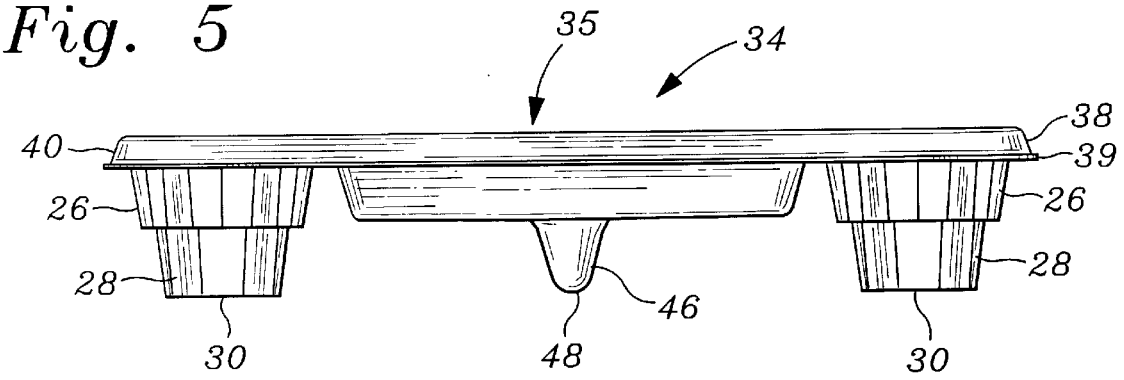
FIG. 5 is a side elevational view of the dinner tray of FIG. 4.
Figure 6:
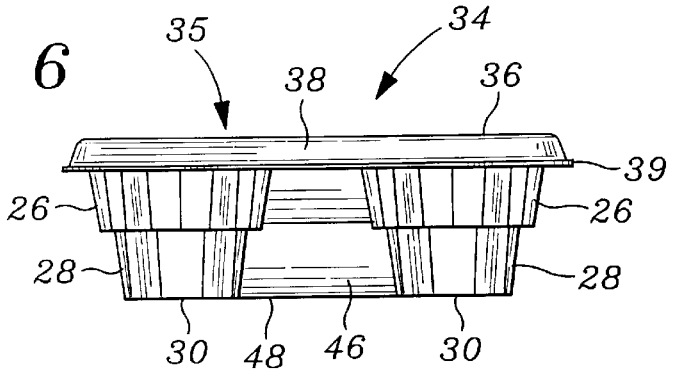
FIG. 6 is an end elevational view of the dinner tray of FIG. 4.

Turning now to FIGS. 4–6, there shown is a second embodiment of a dinner tray 34 having a substantially rectangular body 35, comprised of a flat top surface 36 with a surrounding annular lip 39 and a plurality of cup holding compartments 14 formed at a first end 38 and a second end 40. There are two cup holding compartments 14 at each end, capable of carrying different size beverage containers or cups therein, as explained more fully above, in connection with the cup holding compartments 14 of the first embodiment of the tray. The flat top portion 36 includes an enlarged recessed area centrally thereof, between ends 38, 40, having flat surfaces 42, 44 formed therein and surrounded by a wall 45. Between the flat surfaces 42, 44 there is formed an elongated reservoir or slot 46, similar to the reservoir 22 of the first embodiment of the dinner tray. The elongated reservoir 46 may end in a rounded end portion 48 aligned with the flat bottom surfaces of the cup compartments 14, or may end in a flat surface, such as 32 of the reservoir 22.

Figure 7:
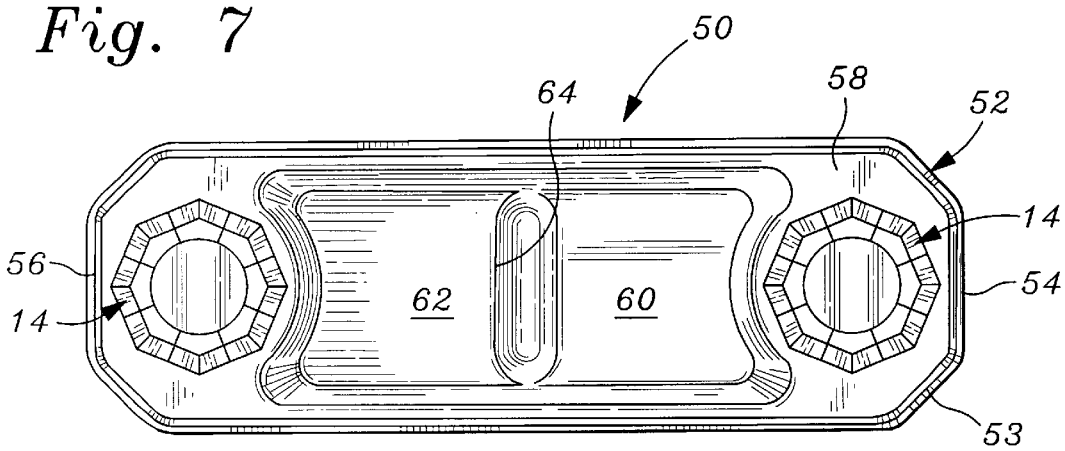
FIG. 7 is a top elevational view of a third embodiment of the improved dinner tray of the present invention.
Figure 8:
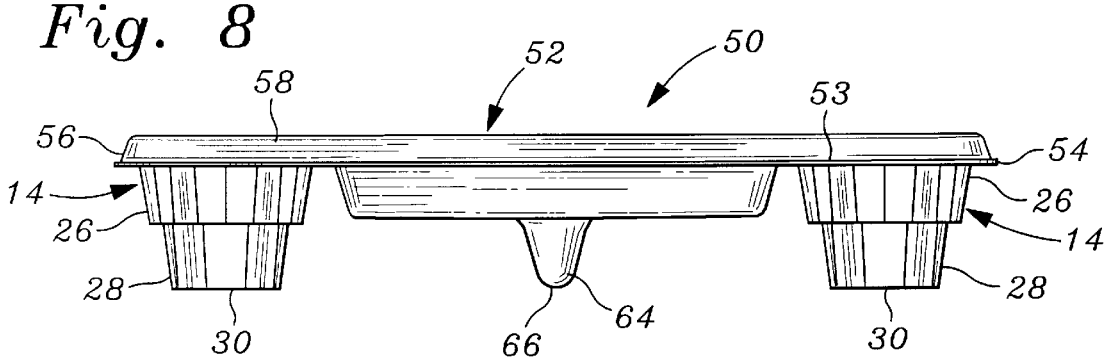
FIG. 8 is a side elevational of the dinner tray of FIG. 7.

A third embodiment of the present invention is shown at 50 in FIGS. 7 and 8 of the drawings. This third embodiment is comprised of an elongated substantially rectangular body 52 having rounded or slanted corner portions, an annular lip 53 and a single cup holding compartment 14 at each of its ends 54, 56, a flat top surface 58, and a pair of flat inner support surfaces 60, 62 separated by an elongated reservoir 64, having a rounded base 66.

It, therefore, can be seen that the various embodiments of the dinner tray of the present invention are easily used to conveniently transport and carry beverages, food and condiments, in a safe and secure manner. Such a dinner tray may be placed on any flat surface, such as a table, the ground, or the lap of a user, to facilitate eating and drinking. After use, the tray may be stored for reuse, or, in most instances, thrown away.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A dinner tray for carrying food and beverages, comprising, in combination:

a substantially rectangular body having a top, two ends, a plurality of cup holding compartments, and a food holding surface formed therein;

each of the plurality of cup holding compartments is octagonal in shape, and includes a plurality of slits formed therein;

a condiment holding area formed adjacent the food holding surface;

a raised wall surrounding the food holding surface and the condiment holding area; and means for holding various size cups in the plurality of cup holding compartments.

2. The dinner tray of claim 1 wherein the plurality of cup holding compartments include flattened bases to aid in supporting the dinner tray on a flat surface.

3. The dinner tray of claim 2 wherein each of the plurality of cup holding compartments includes a pair of stepped areas to hold various size cups therein.

4. The dinner tray of claim 1 wherein the condiment holding area is an elongated reservoir having a supporting base.

5. The dinner tray of claim 4 wherein there are two octagonal shaped cup holding compartments formed at a first end of the substantially rectangular body, and the elongated reservoir is formed at a second end of the substantially rectangular body.

6. The dinner tray of claim 5 wherein the two octagonal shaped cup holding compartments include flat, circular bases, and the supporting base of the elongated reservoir is flat.

7. The dinner tray of claim 4 wherein there are two shaped octagonal cup holding compartments, one of which is formed at each of the two ends, and the elongated reservoir is located in the dinner tray between the two octagonal cup holding compartments.

8. The dinner tray of claim 7 wherein the two octagonal cup holding compartments include flat, circular bases.

9. The dinner tray of claim 4 wherein there are four octagonal shaped cup holding compartments, two of which four octagonal shaped cup holding compartments are formed at each of the two ends, and the elongated reservoir is located in the dinner tray between the two octagonal shaped cup holding compartments at each of the two ends.

10. The dinner tray of claim 9 wherein the four octagonal cup holding compartments include flat, circular bases.

11. A dinner tray for carrying food, beverages and condiments, comprising, in combination:

a substantially rectangular body having a flat top surface, a first end, a second end, two sides and an annular lip;

a plurality of octagonal shaped cup holding compartments formed at the first end;

an elongated condiment holding reservoir formed at the second end extending between the two sides;

a flat food holding surface having a raised wall formed in the flat top surface, between the plurality of octagonal shaped cup holding compartments and the elongated condiment holding reservoir; and means for holding various size cups in the plurality of octagonal cup holding compartments.

12. The dinner tray of claim 11 wherein the means for holding various size cups in the plurality of octagonal cup holding compartments consists of a pair of different size stepped areas and a plurality of slits formed in each of the different size stepped areas.

13. The dinner tray of claim 12 wherein there are two octagonal cup holding compartments and the pair of different size stepped areas are comprised of an upper, larger size octagonal shaped area and a lower, smaller size octagonal shaped area.

14. The dinner tray of claim 13 wherein the lower, smaller size octagonal shaped area of each of the two octagonal cup holding compartments has a substantially circular flat base.

15. A dinner tray for carrying food, beverages and condiments, comprising, in combination:

a substantially rectangular body having a flat top surface, a first end, a second end, two sides and an annular lip surrounding the substantially rectangular body;

at least one octagonal shaped cup holding compartment at the first end and the second end;

a flat food holding surface formed in the substantially rectangular body between the at least one octagonal shaped cup holding compartment at the first end and the second end;

an elongated condiment holding reservoir formed in the flat food holding surface, extending between the two sides, centrally between the at least one octagonal shaped cup holding compartment at the first end and the second end;

a raised rim surrounding the flat food holding surface and the elongated condiment holding reservoir; and means for holding various size cups in the at least one octagonal shaped cup holding compartment at the first end and the second end.

16. The dinner tray of claim 15 wherein the means for holding various size cups in the at least one octagonal shaped cup holding compartment at the first end and the second end is comprised of two different sized portions, and a plurality of slits formed in each of the different sized portions.

17. The dinner tray of claim 16 wherein the two different sized portions consist of a first upper, larger size octagonal shaped area and a second lower, smaller size octagonal shaped area.

18. The dinner tray of claim 17 wherein the second lower, smaller size octagonal shaped area has a substantially flat, circular base.

19. The dinner tray of claim 15 wherein there are two octagonal shaped cup holding compartments at the first end and the second end.

* * * * *